United States Patent [19]

Torta

[11] Patent Number: 4,765,015

[45] Date of Patent: Aug. 23, 1988

[54] FLOOR SWEEPING BLADE DEVICE FOR SURFACE CLEANING MACHINES

[75] Inventor: Nello Torta, Felegara di Medesano, Italy

[73] Assignee: Idroplina S.r.l., Sanguinaro di Fontanellato, Italy

[21] Appl. No.: 122,194

[22] Filed: Nov. 18, 1987

[30] Foreign Application Priority Data

Jan. 28, 1987 [IT] Italy ..... 20657/87[U]

[51] Int. Cl.[4] ..... A47L 1/06

[52] U.S. Cl. ..... 15/245; 15/401

[58] Field of Search ..... 15/245, 401, 320

[56] References Cited

U.S. PATENT DOCUMENTS

| | | | |
|---|---|---|---|
| 2,677,144 | 5/1954 | Parry | 15/245 X |
| 2,876,484 | 3/1959 | Wells | 15/401 X |
| 3,277,511 | 10/1966 | Little et al. | 15/340 X |
| 3,324,499 | 6/1967 | West | 15/401 X |
| 3,496,591 | 2/1970 | Sheler | 15/401 X |
| 3,739,421 | 6/1973 | Fukuba | 15/415 X |

FOREIGN PATENT DOCUMENTS

| | | | |
|---|---|---|---|
| 1271508 | 8/1961 | France | 15/401 |

*Primary Examiner*—Chris K. Moore

*Attorney, Agent, or Firm*—Browdy and Neimark

[57] ABSTRACT

A floor sweeping blade device for surface cleaning machines is disclosed which comprises a body (3) having a main direction of extension and being split into a plurality of portions (3*a*,3*b*) which are consecutively arranged, rigid, and articulated to one another, and flexible blades (8) carried on the body (3) and lying substantially parallel to one another and to said main direction of extension, each having a working edge (8*a*) adapted to rest directly onto a surface (6) being swept, the blades (8) also extending continuously between the portions (3*a*,3*b*) and being deformable elastically by the mutual oscillations of the portions (3*a*,3*b*).

10 Claims, 1 Drawing Sheet

FLOOR SWEEPING BLADE DEVICE FOR SURFACE CLEANING MACHINES

BACKGOUND OF THE INVENTION

The invention relates to a floor sweeping blade device for surface cleaning machines, in particular as used on paved surfaces.

As is known, floor and general surface cleaning machines are currently available commerically, and also manufactured by the Applicant, which are referred to as "auto-scrubbers".

Such machines are of a self-propelled type, controlled by means of a specific steering device, and equipped, for the cleaning operations, within a rigid frame, a clean washing water reservoir and a reservoir for reclaimed foul water, members operative to dispense the clean water and drawn in the foul water, rotating power driven brushes held constantly wet by the washing water, and a floor sweeping device extending across the machine direction of travel and being located rearwardly of the brushes.

The floor sweeping device comprises a metal strip of one-piece construction having a main longitudinal direction across the machine direction of travel. The strip is carried centrally on a tubular element and has a substantially inverted U-shaped cross section. Rigid with the strip are two blades set side-by-side apart from each other, which rest with an edge thereof on the surface to be swept. Between the blades a suction device is usually arranged to operate the suction flow whereof is directed through said tubular carrier element.

To ensure constant adhesion of the blades on the various surfaces being swept, even where the latter are not truly flat, the blade holding strip has been made generally tilting and oscillating such that it can adapt itself spontaneously to a surface being swept. Further, special controls have been provided to best control the pressure of the blades on the surface.

Thus, satisfactory cleaning levels have been achieved, but limited to not too irregular surfaces and only by the use of a blade length not exceeding one meter.

Highly irregular paved surfaces and blade lengths above one meter currently pose, instead, unsurmountable problems of blade adhesion. in fact, the strip oscillability and adjustment of the blade pressure are inadequate to provide a good contact with the ground. Thus, it occurs, for example, that either or both ends of the blade are held slightly off, in the presence of a central bulge, or that a central region of the blades is held off in the presence of an intermediate depression. Accordingly, known floor sweeping device have a relatively short length, requiring as a result a large number of passes to span a given surface, and fail to provide optimum results over irregular paved surfaces.

SUMMARY OF THE INVENTION

This being the situation, it is the general object of this invention to provide a floor sweeping blade device which can substantially remedy the drawbacks noted above.

Within this general object, it is an important object of this invention to provide a device which affords optimum results, even on irregular surfaces and if implemented in lengths exceeding one meter.

Another important object is to provide a device of simple construction, low cost, and high reliability.

These objects are substantially achieved by a floor sweeping blade device for surface cleaning machines, comprising:

a body having a main extension direction;

flexible blades carried on said body and extending substantially parallel with one another and said main extension direction;

said blades having a working edge adapted to rest directly onto a surface to be swept;

the device being characterized in that said body is split into rigid consecutive portions in mutual articulated relationship and mutually oscillable in substantially parallel planes with said blades;

and in that each said blade extends continuously even between said portions of said body;

said blades being deformable elastically by mutual oscillations of said portions.

BRIEF DESCRIPTION OF THE DRAWINGS

Further features and the advantages of the invention will be apparent from the following description of a floor sweeping device, to be taken in conjunction with the accompanying illustrative drawings, where.

DESCRIPTION OF THE PREFERRED EMBODIMENT OF THE INVENTION

Figure 1:
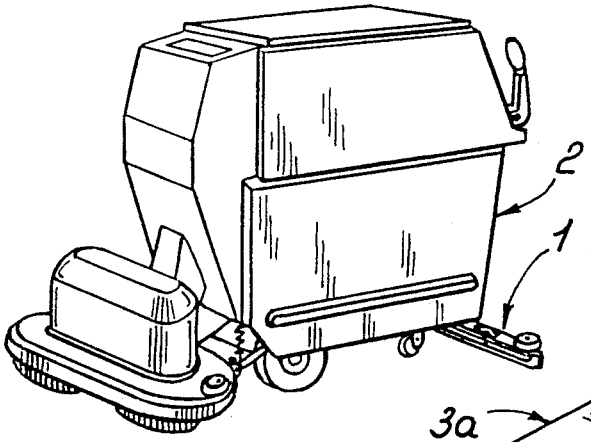
FIG. 1 shows illustratively and schematically a general perspective view of a cleaning machine incorporating a floor sweeping blade device according to the invention.
Figure 4:
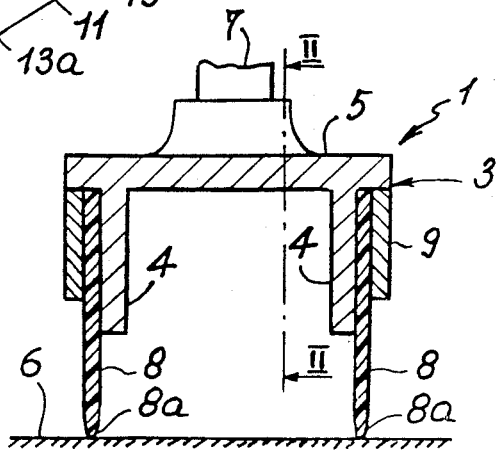
FIG. 4 shows schematically a cross-sectional view taken through the device along the line IV—IV in FIG. 2.

With reference to the cited drawing figures, the floor sweeping device is comprehensively designated 1, and is shown in FIG. 1 as incorporated to a machine 2 of the so-called "wash-and-dry" type. The device 1 comprises a rigid body or strip 3, e.g. of metal, which has a main longitudinal direction of extension (FIG. 2) and a cross-section in the shape of an inverted U. in particular, said sectional shape shows (FIG. 4) longitudinal sides or side frames 4 set apart from each other, and an integral plate 5 with the side frames 4 lying substantially perpendicularly thereto. The plate 5 is, moreover, substantially parallel with a surface to be swept, denoted by the numeral 6, and defines a top face or edge **5*a*, while the side frames 4 define, with their remotest sections from the plate 5, bottom edges 4*a* of the body 3. The body 3 tapers toward its longitudinal ends and is engaged centrally by a suction pipe 7**.

The side frames 4 are engaged externally by blades 8 of an elastically deformable material, such as rubber, para rubber, plastics, or some other suitable material. The blades 8 extend in length to span the whole body 3 and in height, between the plate 5 and the surface 6 to be swept. At the latter they have working edges **8*a***.

The blades 8 are attached to the side frames 4 via outer straps 9 and suitable connection elements extending between the side frames and the straps 9. The straps 9 may be of any desired, stiff or flexible, material and may be provided in several aligned sections or in elements having the same length as the blades. The embodiment comprising rigid straps split into several aligned sections is illustratively preferred.

The plate 5 carries small wheels 10 for guarding the device 1 against bumping.

The body 3 is preferably split into three rigid consecutive segments or portions (FIG. 2): a central portion 3a and two end portions 3b which are all aligned and consecutive to one another. The three portions may be obtained directly by cutting up a single piece body 3. In fact, the confronting surfaces of said portions extend along substantially perpendicular planes to the main longitudinal direction of the body 3.

In the embodiment shown, the length of the central portion 3a is approximately twice the length of each end portion 3b.

The portions 3a, 3b are loosely aligned and articulated together to be mutually oscillable in two opposite directions in transverse planes to the surface 6.

In fact, connection hinges 11 are provided which allow said portions to oscillate in opposite angular directions in said planes, defining pivot axes substantially intermediate to the top 5a and bottom 4a edges. The oscillation limits are established by positions of mutual opposition which the portions, and in particular the edges 4a, 5a thereof, will occupy when rotated.

The hinges 11 are practically embodied by strips 12 engaged with the side frames 4 by pins. These pins are divided into two connection pins 13 arranged on one side of the strips 12, at the central portion 3a of the body 3, and one knuckle pin 13a on the other side of the strips 12, at the end portions 3b. This knuckle pin 13a acts as a fulcrum.

Figure 2:
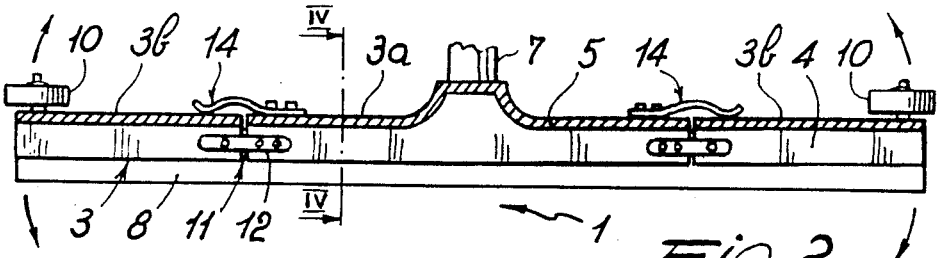
FIG. 2 is a longitudinal section taken through the device along the line II—II in FIG. 4.
Figure 3:
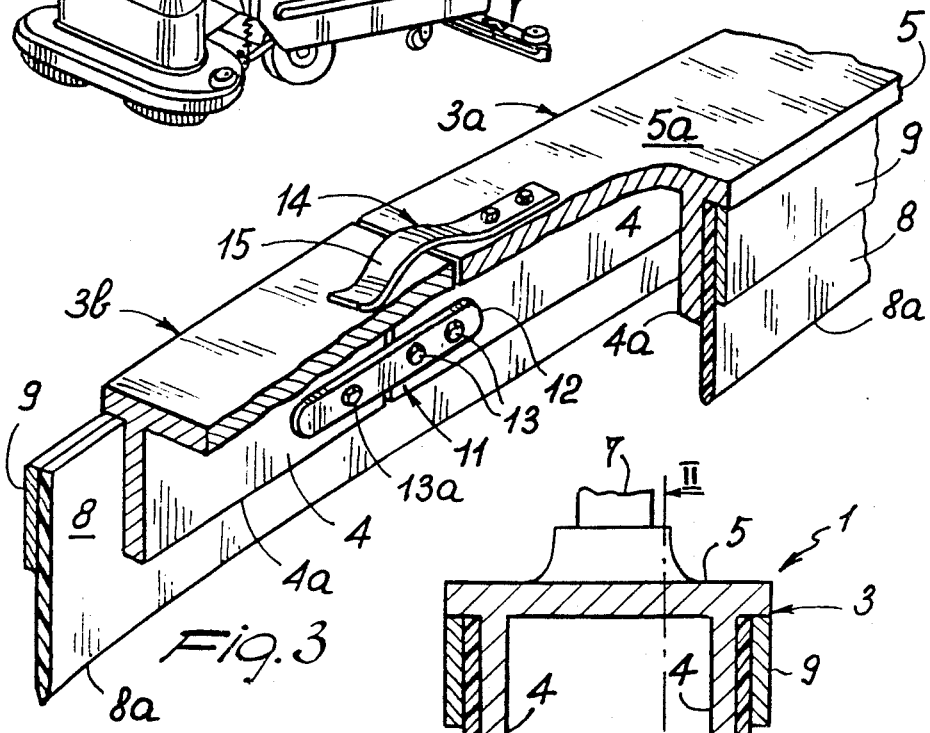
FIG. 3 shows a cutaway perspective view of a portion of the device.

FIGS. 2 and 3 show then the device 1 is provided with elastic means 14 operative to bend the end portions 3b toward the surface 6. These elastic means are embodied by elastic reeds 15 placed on the top edge or face 5a of the plate 5, astride two consecutive portions of the body 3. In the figures, the reeds 15 are all attached to the central portion 3a.

The device operates as follows.

With the machine 2 operated over floorings or truly flat surfaces, the device 1 operates with its portions 3a, 3b aligned together, and the continuous character of the blades 8 ensures an excellent finish. If on the contrary, the surface 6 is an irregular one, the two end portions 3b oscillate in an angular direction to adjust the profile of the body 3 to the irregularities of the surface. Note is made of that the oscillations may take place, at each end portion 3b, in either angular directions.

The blades 8 deform partially and elastically and follow the oscillations of the end portions 3b without losing their continuity.

The elastic means 14 hold the blades 8 constantly against the surface 6.

Thus, the device of this invention, while being simple construction-wise and easily implemented, can operate in an optimum manner over very irregular surfaces and can also accept blades of great length.

I claim:

1. A floor sweeping blade device for surface cleaning machines, comprising a body (3) having a main direction of extension, flexible blades (8) carried on said body (3) and extending substantially parallel with one another and said main direction of extension, said blades (8) having a working edge (8a) adapted to rest directly onto a surface (6) to be swept, the device being characterized in that said body (3) is split into rigid consecutive portions (3a, 3b) in mutual articulated relationship and mutually oscillable in substantially parallel planes with said blades (8), and in that each said blade (8) extends continuously even between said portions (3a, 3b), said blades (8) being deformable elastically by mutual oscillations of said portions (3a, 3b).

2. A device according to claim 1, characterized in that said portions (3a, 3b) of said body (3) have mutually confronting ends set loosely apart from each other, and in that these same portions are articulated together by means of hinges (11) effective to allow angular oscillations in two opposite directions.

3. A device according to claim 2, characterized in that said portions (3a, 3b) are provided with top edges (4a) and bottom edges (5a) adapted to define limits for the angular oscillation of said portions (3a, 3b), said edges being adapted to be arranged in positions of mutual contact and interference.

4. A device according to claim 2, characterized in that said hinges (11) are strips (12) and connection pins (13, 13a) for connecting said strips (12) to said portions (3a, 3b), providing articulation therebetween, said pins (13, 13a) being substantially perpendicular to said blades (8).

5. A device according to claim 1, characterized in that said body (3) is provided, between said portions (3a, 3b), with elastic means (14) acting on these same portions (3a, 3b) in directions tending to bring said blades (8) closer to said surface (6) to be swept.

6. A device according to claim 5, characterized in that said elastic means (14) comprise elastic reeds (15) extending between adjacent sections of said portions (3a, 3b).

7. A device according to claim 6, characterized in that elastic reeds (15) are arranged at a top edge (5a) of said body (3).

8. A device according to claim 1, characterized in that said body (3) is split into a central portion (3a) and two end portions (3b), the latter being arranged to be oscillable in opposite directions relatively to said central portion (3a).

9. A device according to claim 8, characterized in that said central portion (3a) has a greater length than the length of each said end portion (3b).

10. A device according to claim 9, characterized in that two such blades (8) are provided substantially parallel to and spaced apart from each other, each blade extending substantially continuously throughout the length of said body (3) in said main direction of extension.

* * * * *